299-13 SR
4/3/84 XR 4,440,444

United States Patent [19]
Ricketts

[11] 4,440,444
[45] Apr. 3, 1984

[54] METHOD FOR CONTROLLING VOID IN AN IN SITU OIL SHALE RETORT

[75] Inventor: Thomas E. Ricketts, Grand Junction, Colo.

[73] Assignee: Occidental Oil Shale, Inc., Grand Junction, Colo.

[21] Appl. No.: 273,972

[22] Filed: Jun. 15, 1981

[51] Int. Cl.[3] ..... E21C 41/10
[52] U.S. Cl. ..... 299/2; 299/13
[58] Field of Search ..... 299/2, 13, 19

[56] References Cited

U.S. PATENT DOCUMENTS

| | | | |
|---|---|---|---|
| 3,586,377 | 6/1971 | Ellington | 299/2 |
| 3,917,346 | 11/1975 | Janssen | 299/13 |
| 3,980,339 | 9/1976 | Heald | 299/13 |
| 4,017,119 | 4/1977 | Lewis | 299/2 |
| 4,289,354 | 9/1981 | Zakiewicz | 299/13 |

*Primary Examiner*—William F. Pate, III
*Attorney, Agent, or Firm*—Christie, Parker & Hale

[57] ABSTRACT

Liquid and gaseous products are recovered from an in situ oil shale retort formed in a retort site in a subterranean formation containing oil shale. A void is excavated in the subterranean formation within the boundaries of the retort site and a zone of unfragmented formation is left in the retort site adjacent the void. A retort inlet is at one upper edge of the retort site and a retort outlet is at the lower edge of the retort site opposite the retort inlet.

Explosive charges are placed in the zone of unfragmented formation and detonated in an asymmetrical time delay sequence for forming a fragmented permeable mass of formation particles which substantially fills the retort to the top boundary in the region of the retort inlet. A combustion zone is formed in the fragmented permeable mass adjacent the inlet and a retort inlet mixture comprising an oxygen-supplying gas is introduced into the fragmented mass for sustaining the combustion zone and advancing the combustion zone diagonally through the fragmented mass from the inlet toward the outlet. A retorting zone is on the advancing side of the combustion zone for producing liquid and gaseous products and the liquid and gaseous products are withdrawn through the retort outlet.

45 Claims, 5 Drawing Figures

METHOD FOR CONTROLLING VOID IN AN IN SITU OIL SHALE RETORT

FIELD OF THE INVENTION

This invention relates to in situ recovery of oil shale and, more particularly, to a method for forming and operating an in situ oil shale retort in a subterranean formation containing oil shale.

BACKGROUND OF THE INVENTION

The presence of large deposits of oil shale in the high plateau, semi-arid region of the western United States has given rise to extensive efforts to develop methods for recovering shale oil from kerogen in the oil shale deposits. It should be noted that the term "oil shale" as used in the industry is, in fact, a misnomer; it is neither shale nor does it contain oil. It is a sedimentary formation comprising marlstone deposit with layers containing an organic polymer called "kerogen" which, upon heating, decomposes to produce liquid and gaseous products. It is the formation containing kerogen that is called "oil shale" herein and the liquid hydrocarbon product is called "shale oil". A number of methods have been proposed for processing oil shale which involve either first mining the kerogen-bearing shale and processing the shale on the ground surface, or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits has been described in several patents such as U.S. Pat. Nos. 3,661,423; 4,043,597; 4,043,598; and 4,192,554; and in U.S. Pat. application Ser. No. 070,319 filed Aug. 27, 1979, by Chang Yul Cha, entitled TWO-LEVEL, HORIZONTAL FREE FACE MINING SYSTEM FOR IN SITU OIL SHALE RETORTS. Each of these applications and patents is assigned to Occidental Oil Shale, Inc., assignee of this application, and each is incorporated herein by this reference.

These patents and applications describe in situ recovery of liquid and gaseous hydrocarbon materials from a subterranean formation containing oil shale, wherein such formation is explosively expanded to form a stationary fragmented permeable mass of formation particles containing oil shale within the formation, referred to herein as an in situ oil shale retort, or merely as a retort. Retorting gases are passed through the fragmented mass to convert kerogen contained in the oil shale to liquid and gaseous products, thereby producing retorted oil shale. One method of supplying hot retorting gases used for converting kerogen contained in the oil shale, as described in U.S. Pat. No. 3,661,423, includes igniting the upper level of the shale for establishing a combustion zone in the retort and introducing an oxygen-supplying retort inlet mixture into the retort to advance the combustion zone downwardly through the fragmented mass. In the combustion zone, oxygen from the retort inlet mixture is depleted by reaction with hot carbonaceous materials to produce heat, combustion gas, and combusted oil shale. By the continued introduction of the retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to produce kerogen decomposition, called "retorting". Such decomposition in the oil shale produces gaseous and liquid products, including gaseous and liquid hydrocarbons, and a residual carbonaceous material.

The liquid products and the gaseous products are cooled by the cooler oil shale fragments in the retort on the advancing side of the retorting zone. The liquid hydrocarbon products, together with water produced in or added to the retort, collect at the bottom of the retort and are withdrawn. An off-gas is also withdrawn from the bottom of the retort. Such off-gas can include carbon dioxide generated in the combustion zone, gaseous products produced in the retorting zone, carbon dioxide from carbonate decomposition, and any portion of the gaseous retort inlet mixture that does not take part in the combustion process.

U.S. Pat. Nos. 4,043,597; 4,043,598; and 4,192,554 disclose methods for explosively expanding formation containing oil shale toward horizontal free faces to form a fragmented mass in an in situ oil shale retort. According to such a method, a plurality of vertically spaced apart voids of similar horizontal cross-section are initially excavated one above another within the retort site. A plurality of vertically spaced apart zones of unfragmented formation are temporarily left between the voids. A plurality of horizontally spaced apart vertical columnar explosive charges, i.e., an array of explosive charges, is placed in each of the unfragmented zones and detonated to explosively expand each unfragmented zone upwardly and/or downwardly toward the void or voids above and/or below it to form a fragmented mass having an average void volume about equal to the void volume of the initial voids. Retorting of the fragmented mass is then carried out to recover shale oil from the oil shale.

U.S. Patent application Ser. No. 070,319 discloses a method for explosively expanding formation containing oil shale toward a horizontal free face to form a fragmented mass in an in situ oil shale retort. According to such a method, a void having a horizontal cross-section similar to the horizontal cross-section of the retort being formed is initially excavated. A plurality of vertically spaced apart zones of unfragmented formation are left above the void. Explosive is placed in each of the unfragmented zones and detonated for explosively expanding such zones toward the void to form a fragmented mass in the retort having an average void volume about equal to the void volume of the initial void. The overlying zones can be expanded toward the void in a single round or a plurality of rounds. Retorting of the fragmented mass is then carried out to recover shale oil from the oil shale.

Past retorting techniques disclose that a combustion zone formed in a vertical in situ oil shale retort is advanced vertically downwardly through the fragmented mass. It has been disclosed that desirably such a combustion zone is flat, extends completely across the retort, and is advanced vertically downwardly in a planar wave.

Problems can be encountered, however, when using such techniques.

For example, it has been found that when formation is explosively expanded to form the fragmented permeable mass of formation particles in an in situ oil shale retort, it is sometimes difficult to completely fill the retort cavity with the fragmented mass. Thus, when explosively expanding formation toward a horizontal free face adjacent a "limited void", the available void volume may not be completely filled and a void space can remain over the fragmented mass in the retort. A "limited void" as used herein is defined as a void which has less available volume than would be required for "free expansion" of formation toward the void. When oil shale is explosively expanded toward an unlimited void, a certain maximum void fraction is present in the unfragmented mass, resulting from such "free expansion". When oil shale is expanded toward a "limited void", the void fraction can be no more than permitted by the available void space of the limited void and may be less due to interaction with unfragmented oil shale, for example. It is believed that with oil shale confined by surrounding walls and capable of expanding only to such a "limited void", gases from the detonation may not have full opportunity to act on the oil shale particles before such particles reach obstructions such as adjacent walls, a face opposite to the expanded formation, or oil shale expanding from the opposite sides of the void.

An in situ retort has, for example, been formed containing a fragmented mass of formation particles having a top surface mounded at about the center of the retort. This resulted in a relatively low void space between the fragmented mass and overlying formation at the center of the retort and a relatively high void space between the fragmented mass and overlying formation near the edges of the retort. This mounding effect is encountered when the blasting pattern comprises a square array of blastholes perpendicular to a horizontal free face toward which formation is expanded with detonation commencing near the center of the retort and progressing in bands generally radially outwardly from the center. Such a blasting pattern tends to cause formation to move toward the center of the retort, thereby resulting in the uppermost part of the mound near the center.

Since past techniques have disclosed that it is desirable that the combustion zone be flat and extend horizontally across the retort, preferably the entire top surface of the fragmented permeable mass is ignited for forming the flat combustion zone. Once the ignition process is complete, an oxygen-supplying gas is then introduced to advance the combustion zone through the retort.

Several problems are encountered with such a processing technique when the retort is not filled and the fragmented mass is mounded.

Firstly, having a void space above the fragmented mass in the region where the mass is ignited is a problem because heating of overlying unfragmented formation during the ignition process can cause thermal sloughing of formation into the void, thereby disrupting ignition. Secondly, the combustion zone formed is not flat, but tends to acquire the mounded or curved shape of the top surface of the fragmented mass. Time-consuming and expensive corrective measures can be required to flatten such a combustion zone.

In the past, in situ oil shale retorts have been formed with a drift communicating with the fragmented mass of formation particles through a side boundary near the bottom of the retort. This drift is used for withdrawal of the gaseous and liquid products of retorting, as well as for withdrawal of retort off-gas.

In such a retort, a combustion zone can be formed across the top of the fragmented mass and advanced vertically through the retort as described above. The retort inlet mixture, which is introduced into the retort to advance the combustion zone, is introduced through one or more inlets which extend vertically through unfragmented formation above the retort. When such an arrangement of retort inlets is used, i.e., when the retort inlet(s) extend vertically through unfragmented formation above the retort and the retort outlet extends through a side boundary at the bottom of the retort, an appreciable quantity of oil shale in the fragmented mass can remain unretorted at the end of the retorting operation. This problem can arise because when the gas outlet is in the form of a drift opening into the retort through its side boundary, gas flow tends to concentrate toward that side of the retort. This results in a combustion zone that does not remain flat and advance uniformly vertically through the retort, but one that advances more rapidly in the region of the retort adjacent the outlet. As a consequence of both the gas flow bypassing portions of the fragmented mass and the combustion zone advancing non-uniformly through the retort, an appreciable volume of oil shale adjacent the side boundary of the retort opposite the retort outlet can be bypassed. The bypassed oil shale can remain unretorted, thereby inhibiting the yield of gaseous and liquid products from the retort.

Additionally, such in situ retorts can be formed hundreds of feet below the ground surface. Therefore, in order to form the above described vertical inlets, a void is excavated above the retort and the inlets are formed from such a void. Although the void above the retort can also be used for forming boreholes into the formation for blasting operations and/or can be used for control of the retort during retorting, it is expensive and time-consuming to excavate such a void.

Consequently, there is the need to develop techniques for avoiding bypassing of oil shale in a retort having an outlet that communicates with the fragmented mass through a side boundary near its bottom, while also avoiding thermal sloughing. Additionally, it is preferable that the number of voids excavated for forming such an in situ oil shale retort be minimized so as to enhance the economics of the overall retorting operation.

SUMMARY OF THE INVENTION

This invention relates to a method for recovering liquid and gaseous products from an in situ oil shale retort. The in situ retort is formed in a retort site in a subterranean formation containing oil shale and contains a fragmented permeable mass of formation particles containing oil shale within top, bottom, and side boundaries of unfragmented formation.

In an exemplary embodiment, at least one void is excavated in the subterranean formation within the top, bottom, and side boundaries of the retort site while at least one zone of unfragmented formation is left within the boundaries of the retort site adjacent such a void. A plurality of horizontally spaced apart explosive charges are placed into such a zone of unfragmented formation for expanding the zone of unfragmented formation toward the void. At least one retort inlet is formed adjacent the intersection of a first side boundary of the retort site and the top boundary of the retort site for introduction of a retort inlet mixture. At least one retort outlet is formed adjacent the intersection of a second side boundary of the retort site and the bottom boundary of the retort site for withdrawal of off-gas. The second side boundary is preferably on the opposite side of the retort site from the first side boundary.

The explosive charges placed into the zone of unfragmented formation are detonated in a time delay sequence comprising first detonating at least one explosive charge located between the horizontal center of the zone of unfragmented formation and the first side boundary of the retort site. Then, after a first time delay, explosive charges are detonated in bands progressing away from such an explosive charge first detonated with an additional time delay between detonation of each successive band of explosive charges. Detonation of the explosive charges expands the zone of unfragmented formation forming the fragmented permeable mass of formation particles in the retort.

In one exemplary embodiment, the explosive charges are detonated in a time delay sequence comprising first detonating either one or a group of explosive charges located between the horizontal center of the zone of unfragmented formation and the first side boundary of the retort site; then, after a first time delay, detonating explosive charges in bands progressing radially outwardly from such an explosive charge or group of explosive charges first detonated.

In another exemplary embodiment, the explosive charges are detonated in a time delay sequence comprising detonating explosive charges in a first row located between the center of the zone of unfragmented formation and the first side boundary of the retort site and thereafter detonating explosive charges in rows progressing laterally from the first row toward at least the second side boundary of the retort site.

The fragmented permeable mass of formation particles formed by explosive expansion of the zone of unfragmented formation substantially completely fills the retort to the top boundary of the retort site in a region adjacent the retort inlet. The fragmented mass is then ignited in the region adjacent the inlet and a retort inlet mixture is introduced into the fragmented mass through the inlet for sustaining the combustion zone. Off-gas is withdrawn from the fragmented mass through the retort outlet, whereby gas flow from the retort inlet toward the retort outlet advances the combustion zone diagonally through the fragmented mass from the inlet toward the outlet and forms a retorting zone on the advancing side of the combustion zone. The retorting zone produces gaseous products of retorting that are withdrawn from the fragmented mass through the retort outlet.

DRAWINGS

These and other features, aspects, and advantages of the present invention will be more fully understood when considered with respect to the following detailed description, appended claims, and accompanying drawings wherein:

DETAILED DESCRIPTION

Figure 1:
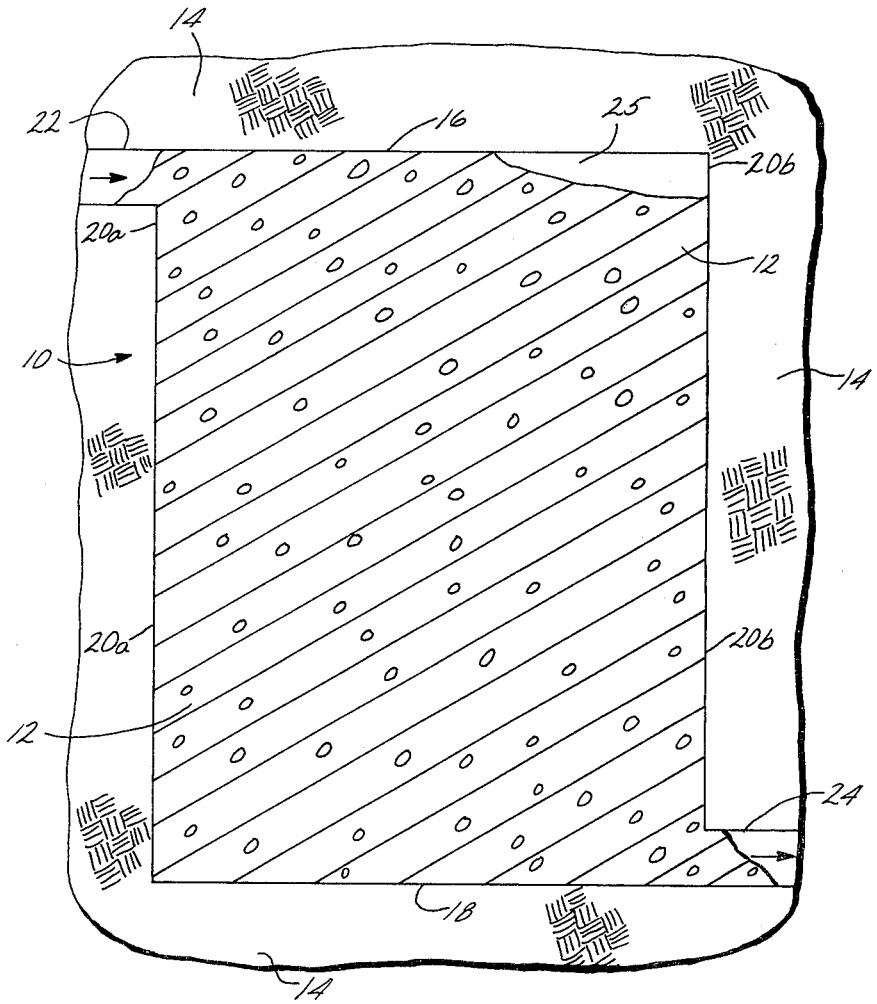
FIG. 1 is a semi-schematic, vertical, cross-sectional view of an in situ oil shale retort formed in a subterranean formation in accordance with practice of principles of this invention.

Referring to FIG. 1, there is shown a semi-schematic vertical cross-sectional view of an exemplary embodiment of an in situ oil shale retort 10 formed in accordance with practice of principles of this invention. The in situ oil shale retort contains a fragmented permeable mass of formation particles 12 and is in a retort site in a subterranean formation 14 containing oil shale. The retort site has a top boundary 16, a bottom boundary 18, and four generally vertically extending side boundaries 20 of unfragmented oil shale formation. In this embodiment, the retort is generally rectangular in horizontal cross-section, but retorts having horizontal cross-sections other than rectangular can also be formed if desired.

In one embodiment of the in situ oil shale retort 10, it is desirable to ignite the retort and introduce a combustion-supporting gas such as oxygen, air, or air or oxygen diluted with steam or off-gas or the like through a drift, i.e., through a retort inlet 22. The retort inlet 22 is preferably at an upper edge of the retort in a zone adjacent the intersection of a first side boundary **20*a* of the retort site and the top boundary 16 of the retort site. Alternatively, ignition and introduction of a retort inlet mixture, i.e., the combustion-supporting gas, can be through a plurality of drifts or boreholes into the retort in a zone adjacent one upper edge. Off-gas and liquid products are withdrawn from the retort through a drift, i.e., a retort outlet 24. Preferably, the retort outlet 24 is adjacent the intersection of a second side boundary 20*b* of the retort site and the bottom boundary 18 of the retort site. The second side boundary 20*b* is on the opposite side of the retort site from the first side boundary 20*a*, i.e., the retort outlet 24** enters the retort in a zone adjacent the lower edge of the retort opposite the retort inlet. Alternatively, off-gas can be withdrawn through a plurality of drifts or boreholes which enter the retort in a zone adjacent such an opposite lower edge.

It will be understood that, as used herein, the terms "inlet" and "outlet" each include either a single opening or a plurality of openings for gas flow.

A substantial void space over the top of a fragmented permeable mass in a retort having the above described configuration can partially short-circuit the desired gas flow which takes a path generally skewed from vertical through the retort from the retort inlet toward the retort outlet. Thus, for example, gas could flow into the retort at one upper edge, through such a void space to the opposite upper edge, and then vertically downwardly through the fragmented mass to the outlet, since such a flow path could have a lower gas flow resistance than the skewed flow path. Additionally, when a void space is between the top of a fragmented mass and the top boundary of the retort, in a region of the retort where the fragmented mass is ignited, overlying unfragmented formation can be heated sufficiently to cause thermal sloughing of formation into the retort. As described above, when formation sloughs into the retort, the ignition process can be inhibited.

It is, therefore, desirable that the fragmented permeable mass of formation particles 12 in the retort 10 substantially fill the retort to the top boundary 16 in the region adjacent the edge through which heat and gas is introduced. Any void space 25 over the fragmented mass is located at the edge opposite the inlet.

In accordance with practice of principles of this invention, the location of such a void space 25 over the top of the fragmented permeable mass in the retort is controlled by a time delay pattern in a round of explosive expansions of unfragmented formation expanded for forming such a fragmented mass.

Exemplary embodiments of methods provided in accordance with this invention for forming the in situ oil shale retort 10 can be understood by referring to FIGS. 2, 3, 4, and 5.

In one exemplary embodiment, a generally rectangular upper level void 26 and a generally rectangular lower level void 28 are excavated within the boundaries of the retort site. A zone of unfragmented formation 30 is left extending between the voids. As is described in greater detail below, the zone of unfragmented formation 30 is explosively expanded toward the voids 26 and 28 to form the fragmented permeable mass of formation particles 12 in the retort.

The horizontal cross-section of the upper void 26 can be about the same as the horizontal cross-section of the retort 10 being formed with each of the four generally vertical side walls of the void forming a portion of the side boundaries of the retort site. The roof of the upper void 26 is the top boundary 16 of the retort site.

Excavation of the upper void 26 can be by means of access through a horizontally extending upper level drift 22 which extends through the first side boundary 20*a* of the retort site. The upper level drift 22 is preferably adjacent the top boundary 16 of the retort site. If desired, more than one such upper level drift can be used.

In an exemplary embodiment, the horizontal cross-section of the lower void 28 is about the same as the horizontal cross-section of the upper void 26 with each of the four generally vertical side walls of the lower void forming a portion of the side boundaries of the retort site. The floor of the lower void is the bottom boundary 18 of the retort site.

The floor 32 of the upper void is the top surface of the zone of unfragmented formation and the roof 34 of the lower void is the bottom surface of the zone of unfragmented formation. The top surface and bottom surface of the zone of unfragmented formation define horizontally extending free faces toward which the zone of unfragmented formation is to be explosively expanded.

Excavation of the lower void 28 can be by means of access through a horizontally extending lower level drift 24 which, in this instance, extends through the second side boundary 20*b* of the retort site. The lower level drift is preferably adjacent the bottom boundary of the retort site. If desired, more than one such lower level drift can be used.

In an exemplary embodiment of practice of this invention, the first side boundary 20*a* is on the opposite side of the retort site from the second side boundary 20*b* and, during retorting operations, the upper level drift or drifts 22 is used for ignition and introduction of combustion-supporting gases into the retort, while the lower level drift or drifts 24 is used for withdrawal of off-gas and products of retorting.

If desired, one or more support pillars (not shown) can be left in each void for temporarily supporting overlying unfragmented formation while the zone of unfragmented formation 30 is being prepared for explosive expansion. When pillars are left in the voids, they are explosively expanded prior to explosive expansion of the zone of unfragmented formation toward the void in which they are located. Explosive expansion of the pillars can be accomplished either in the same round as the expansion of the zone of unfragmented formation or in separate rounds if desired.

In accordance with this invention, the placement of explosive charges in the zone of unfragmented formation 30 and the timing sequence used in the round of detonations of the explosive charges controls the location of any void space remaining between the top of the fragmented permeable mass formed and the top boundary 16 of the retort.

In one exemplary embodiment of practice of this invention, a lower region 30*a* of the zone of unfragmented formation is initially explosively expanded toward the lower void followed by explosive expansion of an upper region 30*b*. The upper region is expanded both downwardly toward the lower void and upwardly toward the upper void.

Figure 2:
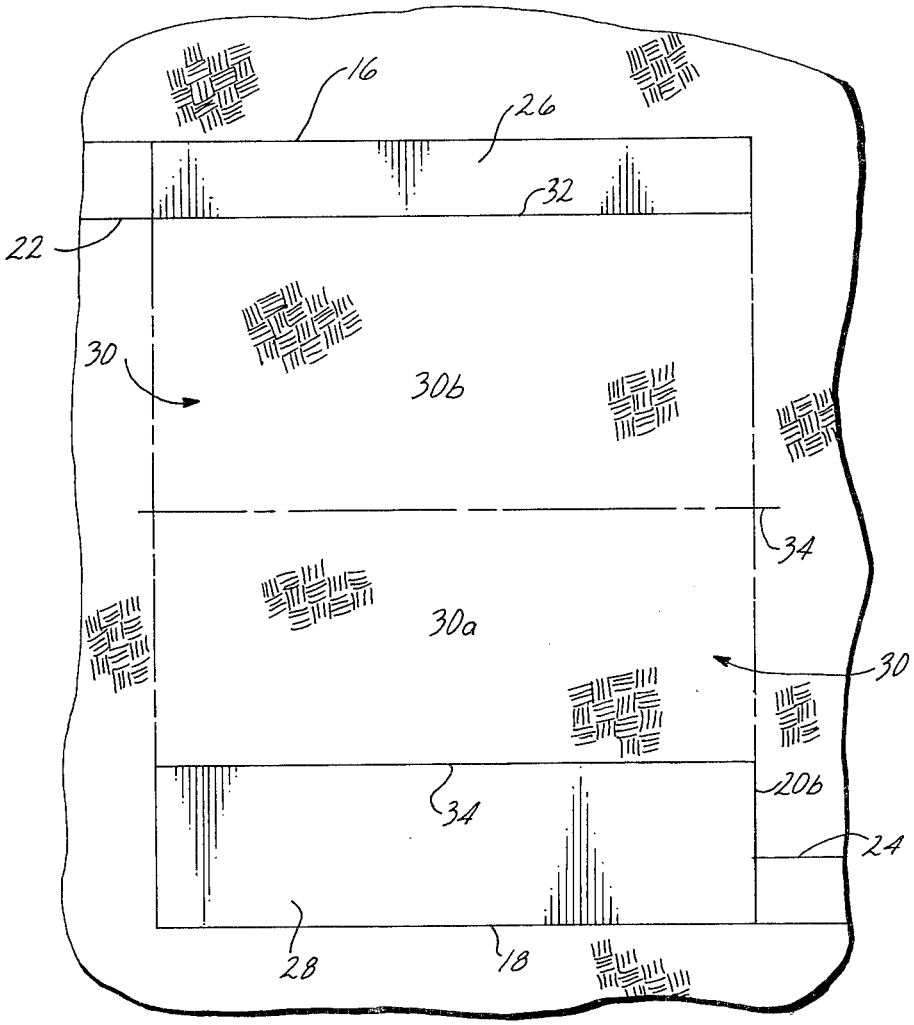
FIG. 2 is a semi-schematic, vertical, cross-sectional view in the subterranean formation at one stage during preparation for forming the in situ retort illustrated in FIG. 1.

In this embodiment, a plurality of horizontally spaced apart blastholes are drilled in the lower region 30*a* of the zone of unfragmented formation from the void 26. The blastholes can alternatively be drilled upwardly into the lower region 30*a* from the void 28 if desired. The blastholes are loaded with explosive forming a plurality of horizontally spaced apart explosive charges in the lower region and the explosive charges are then detonated for explosively expanding the lower region downwardly toward the lower void. For purposes of illustration, the lower region is shown in FIG. 2 as that portion of the zone of unfragmented formation 30 below a horizontal plane 34 passing through the formation. The lower region 30*a* of the zone of unfragmented formation can be expanded toward the lower void in either a single layer of a desirable thickness or in a plurality of separate layers.

The explosive expansion of the lower region of the zone of unfragmented formation can be in a single round or can be in a plurality of separate rounds. For example, if desired, each layer can be expanded in a single round with each successive layer being expanded in separate rounds. Alternatively, all of the layers can be expanded in the same single round. When using separate rounds for expanding the layers, fragmented formation can be withdrawn from the retort after each successive layer is expanded to provide a desirable void volume for expansion of the next successive layer.

A detonation in a single round, as used herein, means detonation of a number of separate explosive charges, either simultaneously or with only a short time delay between separate detonations. A time delay between explosions in a sequence is short when formation explosively expanded by detonation of one explosive charge has either not yet moved or is still in motion at the time of detonation of a subsequent explosive charge.

Figure 3:
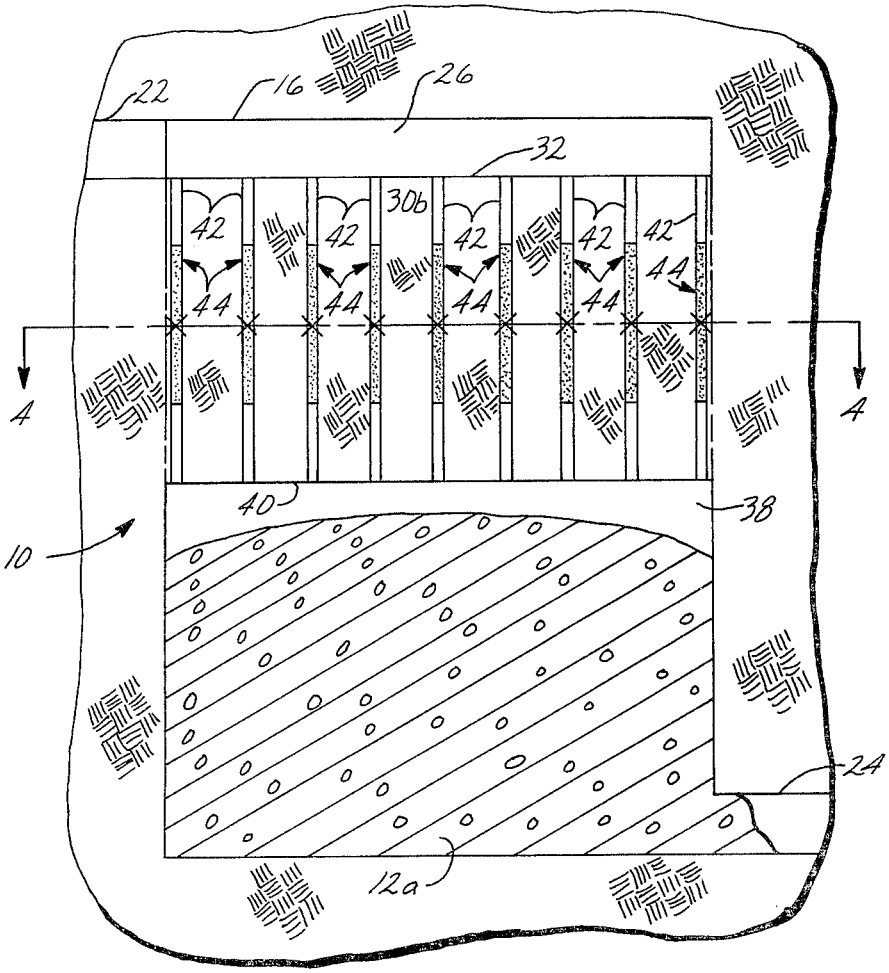
FIG. 3 is a semi-schematic, vertical, cross-sectional view in the subterranean formation at another stage during preparation for forming the retort illustrated in FIG. 1.

As can best be seen in FIG. 3, explosive expansion of the lower region 30*a* of the zone of unfragmented formation forms a first portion 12*a* of the fragmented permeable mass of formation particles in the retort 10. A void space 38 is left between the top of the first portion 12*a* of the fragmented mass and the bottom surface 40 of the upper region **30*b*** of the zone of unfragmented formation.

The upper region of the zone of unfragmented formation is then explosively expanded, preferably in a single round, toward the underlying void space 38 and the overlying void 26.

If desired, before explosive expansion of the upper region **30*b*, a portion of the fragmented permeable mass 12*a* can be withdrawn from the retort to provide a void space 38** having a desired volume or configuration.

In an alternate embodiment, preferably both the upper and lower regions **30*b* and 30*a*, respectively, of the zone of unfragmented formation are explosively expanded in the same single round. In this instance, the portion of the fragmented mass 12*a* is not in a stationary body as shown in FIG. 3**, but is still, at the time the upper region is expanded, moving toward the bottom of the retort.

The upper region **30*b* of the zone of unfragmented formation is prepared for explosive expansion by drilling a plurality of horizontally spaced apart vertical blastholes 42 into the formation from the upper level void 26. If desired, the same blastholes that were used for explosively expanding the lower region 30*a*** of the zone of unfragmented formation can be used for the expansion of the upper region.

An exemplary embodiment of practice of this invention is based on a square array of blastholes 42 formed in the upper region **30*b*** of the zone of unfragmented formation. In a "square array" the spacing distance between adjacent blastholes or explosive charges in such blastholes is about equal.

Figure 4:
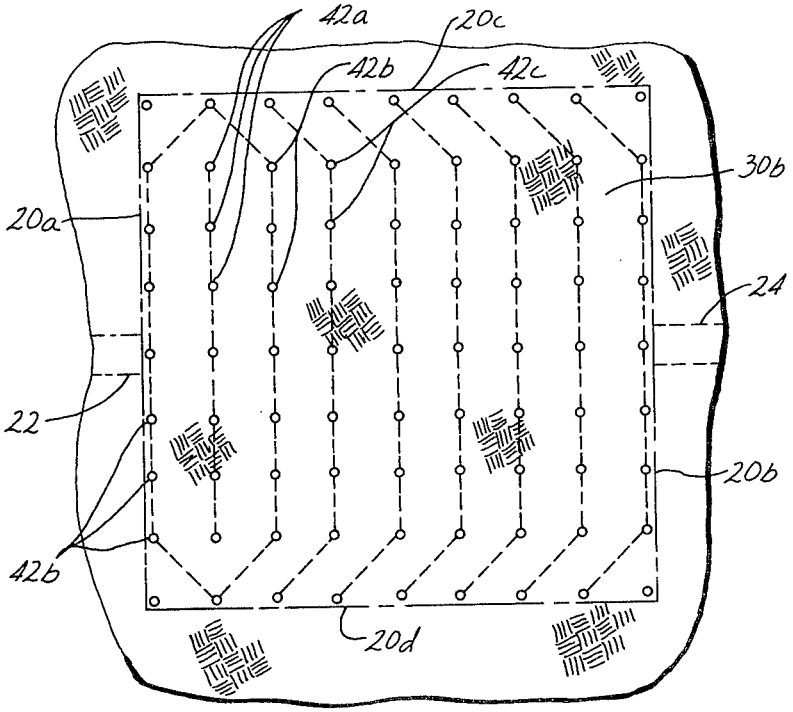
FIG. 4 is a horizontal cross-sectional view taken on line 4—4, of FIG. 3 showing one exemplary embodiment of a blasting pattern used in practice of principles of this invention.

The location of the blastholes 42 of the exemplary embodiment can best be seen by referring to FIG. 4 which is a horizontal cross-sectional view taken on line 4—4 of FIG. 3. For purposes of illustration herein, the square array of blastholes 42 comprises 81 horizontally spaced apart blastholes which are in nine rows or bands having nine blastholes in each row. The rows of blastholes are parallel to the side boundaries of the retort site and extend from the first side boundary **20*a* across the upper region of the zone of unfragmented formation to the second side boundary 20*b***.

Alternatively, if desired, blastholes can be positioned to form other than a square array and the number of blastholes in an array can be different from the number in the present embodiment. For example, although corner charges are provided in the arrays shown in FIGS. 4 and 5, they can be eliminated if desired. Further, the diameter of the blastholes can vary as desired.

The blastholes 42 are loaded with explosive to thereby form a square array of horizontally spaced vertical columnar explosive charges 44 extending across the zone of unfragmented formation. The blastholes 42 and explosive charges 44 are shown out of proportion in FIGS. 3 and 4 for clarity of illustration, i.e., the blastholes are actually much smaller relative to the formation than shown.

Preferably, each explosive charge 44 is in the middle of the upper region **30*b* of the zone of unfragmented formation and extends from the vertical center of the upper region about halfway to each free face toward which the formation is to be explosively expanded, i.e., about halfway toward the bottom surface 40 and halfway toward the top surface 32** of the upper region.

It has been found that having an explosive charge extend through about one-half the thickness of formation being expanded and being located in the middle of the formation results in the most efficient use of explosive. If desired, explosive charges having a length different from one-half the thickness of formation can be used. Further, the charges can be placed at locations in the formation different from the locations shown in the figures.

A detonator designated by an "x" is placed at about the center of each explosive charge, i.e., at about the center of height of the upper zone of unfragmented formation. When the explosive charges 44 are detonated, about the upper half of the upper region of the zone of unfragmented formation is expanded toward the void 26 and about the lower half is expanded downwardly toward the void space 38.

In the exemplary embodiment, each explosive charge has about the same actual depth of burial as each other explosive charge and about the same scaled depth of burial. Alternatively, the charges need not all be the same size. For instance, the charges provided at the side boundaries of the retort can be smaller than those closer to the center to minimize seismic vibration from the blast and overbreak of formation at the retort boundaries.

The "actual depth of burial" as used herein is the distance from the free face toward which formation is to be expanded to the center of the mass of that portion of an explosive charge that expands formation toward that free face. Thus, for example, the effective center of mass or actual depth of burial of each charge 44 is not at the center of the full column of explosive in that blasthole. In this instance, each charge 44 has two effective centers of mass; one at the center of the upper half of the column of explosive, since the upper half of the column expands formation toward the upper free face, i.e., the top surface 32 of the zone of unfragmented formation; and one at the center of the lower half of the column of explosive, since the lower half of the column expands formation toward the lower free face, i.e., the surface 40.

The "scaled depth of burial" (SDOB) as it is used herein is described by B. B. Redpath in an article entitled "Application of Cratering Characteristics to Conventional Blast Design", *Monograph 1 on Rock Mechanics Applications and Mining*, Soc. of Min. Eng. and Am. Inst. of Min. Met. and Pet. Eng., New York (1977). A copy of this article accompanies the application and is incorporated herein by this reference. Briefly, the scaled depth of burial of an explosive charge can be expressed in units of distance over weight to the $\frac{1}{3}$ power or, preferably, distance over energy of explosive to the $\frac{1}{3}$ power. For example, $SDOB = L/W^{\frac{1}{3}}$ with units of millimeters per calorie to the $\frac{1}{3}$ power. The distance, L, referred to as burden distance in the equation for scaled depth of burial, is the actual depth of burial as described hereinabove. The weight or energy, W, of the explosive is the weight or energy of the explosive charge that expands formation toward the free face.

Although it is preferred that a single detonator is used and is placed at about the middle of each charge 44, if desired, such a detonator can be located at a different elevation in each charge or more than one detonator can be used. In either case, the top half of each explosive charge expands an upper portion of the zone of unfragmented formation toward its upper free face, while the bottom half expands a lower portion of the zone toward its lower free face.

The explosive charges 44 are detonated in a time delay sequence which, in accordance with practice of this invention, is selected for controlling the location of a void space over the top of the resulting fragmented permeable mass of formation particles.

In the exemplary embodiment, it is desirable to substantially fill the retort with fragmented formation in a region adjacent the edge through which gas is introduced, i.e., to fill the retort to the top boundary in the region of the juncture of the first side boundary 20*a* and the top boundary 16 of the retort site. Preferably, all of the explosive charges 44 are detonated in a single round.

In one exemplary embodiment shown in FIG. 4, the charges first detonated for explosively expanding the upper region 30*b* of the zone of unfragmented formation are in a row or band of blastholes 42*a* located between the horizontal center of the retort and the side boundary 20*a* through which gas is to be introduced, i.e., between the horizontal center of the retort and the retort inlet 22. The retort inlet 22 and the retort outlet 24 are shown in phantom lines in FIG. 4 because the cross-section is taken on FIG. 3 below the inlet and above the outlet. Additionally, the charges detonated in the same delay are shown connected with dashed lines for purposes of illustration.

Preferably, detonation of the charges in all of the blastholes 42*a* in the row or band is essentially simultaneous with the possible exception of the end charges, i.e., the charges adjacent the side boundaries 20*c* and 20*d*. This results in explosive expansion of a first portion of the zone of unfragmented formation that is located between the horizontal center of the zone and the first side boundary 20*a*. Thereafter, remaining portions of the zone of unfragmented formation are expanded sequentially in a time delay sequence progressing away from the first portion expanded. For example, after the charges in the row 42*a* are detonated, explosive charges are detonated in rows, i.e., bands of blastholes progressing laterally toward at least the second side boundary 20*b* of the retort site.

In the exemplary embodiment, after a first time delay, explosive charges in the rows 42*b* of blastholes on each side of the first row 42*a* are detonated at about the same time. Once again, essentially all of the charges 44 in the blastholes 42*b* are preferably detonated simultaneously with the possible exception of the charges at the end of each row 42*b*. The end charges in the first row 42*a* can, if desired, be detonated at the same time as the charges in the rows 42*b*. After a second time delay, the explosive charges in the row or rows of blastholes 42*c* next further from the first row 42*a* can be detonated and detonations progress thereafter in rows or bands sequentially across the retort site as shown toward the second side boundary 20*b*.

The explosive expansion of formation by detonation of the charges 44 in the first row of blastholes 42*a* provides relief, i.e., a partial free face toward which expansion of formation from detonation of subsequent rows of explosive charges is in part directed. Mounding of the fragmented mass of formation particles formed by such detonations tends to concentrate in the region of the first row detonated. Thus, in this embodiment, mounding is asymmetrical horizontally across the retort site. Mounding of the fragmented mass is higher nearer the first side boundary 20*a* with the top of the fragmented permeable mass 12 preferably being against the overlying unfragmented formation along the inlet side of the retort, i.e., along the side boundary 20*a*. Mounding of the fragmented mass is lower further from the first side boundary 20*a* with the void space remaining between the top of the fragmented mass and the top boundary of the retort tending to concentrate along the opposite edge of the retort site, i.e., along the second side boundary 20*b*. This can be seen in FIG. 1 where the void space 25 is adjacent the second side boundary 20*b* and the fragmented mass 12 substantially completely fills the retort to the top boundary 16 in a region of the retort along the first side boundary 20*a*.

In the embodiment just described, the first delay is in the second row 42*a* of blastholes from the side boundary 20*a* of the retort. If desired, the first delay can be in the third or any subsequent row from the side boundary 20*a* as long as the row is between the center of the retort and the side boundary 20*a* through which inlet gas is introduced. It is undesirable, however, to commence detonation in the row of blastholes adjacent the first side boundary 20*a* since there is little upward relief for expansion of formation in that region due to the inhibiting effect of the void wall. Commencing detonation in the row of blastholes adjacent the first side boundary can, therefore, result in poor fragmentation and low permeability in that region.

Preferably, the first row of explosive charges detonated is at least about one crater radius from the side boundary 20*a*. Said another way, it is preferable to commence detonation in blastholes that are between the horizontal center of the zone of unfragmented formation and a location which is at least about one crater radius from the side boundary through which retort inlet gases are introduced. More preferably, the explosive charges first detonated are about one crater radius from the side boundary 20*a*.

The crater radius of an explosive charge is defined as the radius of the true crater formed by the detonation of such an explosive charge toward an effectively infinite free face, i.e., toward a free face that is not confined by vertical walls of unfragmented formation, such as the walls of the void 26. The crater radius of an explosive charge can be estimated theoretically or determined by field testing. In the above described embodiment, the crater radius of each charge is determined for either the upper or lower half of the charge since the upper half expands formation toward the upper free face and the lower half expands formation toward the lower free face.

When a plurality of explosive charges are placed in a row, the charges can interact and enhance one another when detonated in a single round. The resulting crater adjacent one such charge can be somewhat broader than the crater formed by a single isolated charge. Thus, in some embodiments, the effective crater radius of a row of charges can be somewhat greater than the crater radius when one such charge is detonated separately.

As used herein, therefore, the term "crater radius" can refer to the radius of a crater formed by an individual explosive charge when such a charge does not interact with other charges, or to the radius of a crater formed by an individual charge in a row of interacting charges.

It has been found that when explosive charges are less than about one crater radius from the walls of a void, the formation expanded by detonation of such an explosive charge is partially directed away from the wall and inwardly toward the center of the retort. This is due to interference between the side walls of such a void and the formation being expanded. Additionally, it has been found that when the explosive charges are one crater radius or farther from the side wall, formation expanded by detonation of such charges is not interferred with by the void walls.

Since it is desired that the retort be filled with the fragmented permeable mass in the region adjacent the retort inlet, it is undesirable that explosive charges in the first row 42*a* detonated be closer than one crater radius from the side boundary 20*a* because formation from such a detonation can be directed to a greater extent than desired toward the center of the retort. Additionally, because of the inhibiting effect of the void walls, the degree of fragmentation can be less than desired.

Alternatively, when the first row of explosive charges detonated is more than one crater radius from the wall, the resulting mounding which tends to take place at the locus of the first row detonated can be further from the side wall than desired. This can inhibit the substantial filling of the retort with a fragmented mass in the region adjacent such a side wall.

Figure 5:
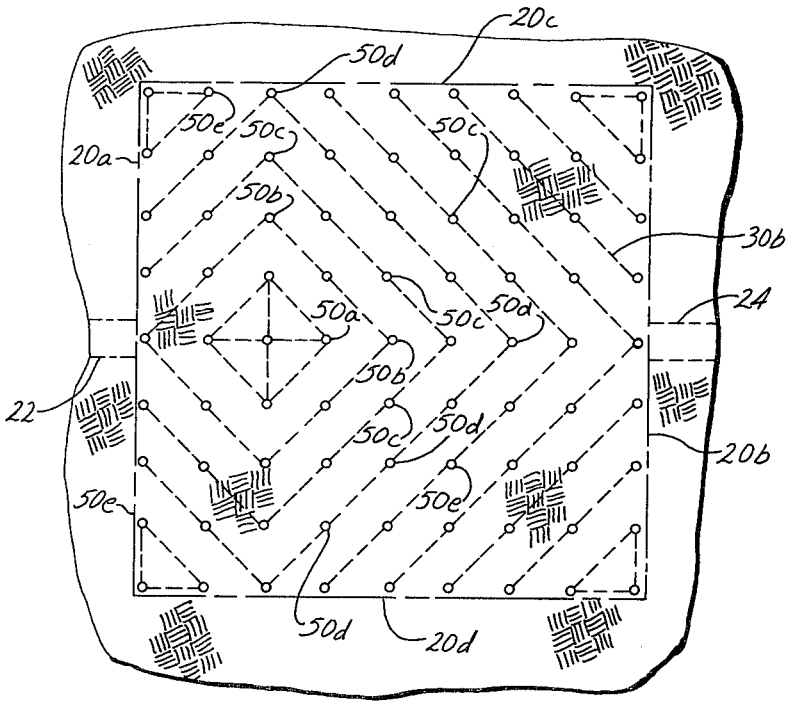
FIG. 5 is a horizontal cross-sectional view similar to FIG. 4 showing another exemplary blasting pattern used in practice of principles of this invention.

Another exemplary embodiment, also based on a square array of blastholes, is illustrated in FIG. 5 which is a horizontal cross-section of the upper region 30*b* of the zone of unfragmented formation similar to the cross-section shown in FIG. 4. In this embodiment, explosive charges are placed into blastholes 50 in the upper region of the zone of unfragmented formation and detonated in a single round. Initially, explosive charges are detonated in a group of five blastholes 50*a* located between the horizontal center of the zone of unfragmented formation and the edge of the retort adjacent the inlet 22, i.e., adjacent the first side boundary 20*a*. After a time delay, explosive charges are detonated in a band of blastholes 50*b* surrounding the initial five charges and subsequent delays progress in surrounding bands 50*c*, 50*d*, 50*e*, and so forth, radially outwardly from the region of the first delay until all of the explosive charges are detonated. This arrangement tends to leave any void space between the top of the fragmented mass and the overlying unfragmented formation in a generally U-shaped region along the side boundary 20*b* opposite the side boundary 20*a* and adjacent the side boundaries 20*c* and 20*d*. The fragmented mass formed fills the retort in a region near the first few bands of explosive charges detonated.

Preferably, the charges in the blastholes 50*a* are located between the horizontal center of the retort and the retort inlet 22. This arrangement tends to fill the retort in the region of such an inlet which, as described above, inhibits both gas bypassing of the desired skewed gas flow path through the rubble and thermal sloughing of formation during ignition.

Although, in this embodiment, five charges are detonated in the first group, more or less than five charges can be detonated in such a first group if desired. Also, in this embodiment, as was the case in the first described embodiment, it is preferable that all of the explosive charges in the blastholes 50*a* are at least one crater radius from the side boundary 20*a* and, preferably, the charge in the blasthole 50*a* nearest the first side boundary 20*a* is about one crater radius from that side boundary.

In each of the above described embodiments, the time delay between successive detonations of explosive charges in the round should be at least one millisecond per foot of spacing between adjacent blastholes. This allows for sufficient time for a new free face to form so that expansion of formation from a subsequent detonation is directed toward the locus of charges detonated in a previous detonation. If desired, appreciably longer delays such as about 10 milliseconds and up to about 20 milliseconds per foot can be used to accentuate the asymmetry of the mounding and further insure that any void space over the fragmented mass is located away from the location where gas is introduced.

If the delay is greater than about 20 milliseconds per foot of spacing, the formation can move too far before the next detonation which can result in a region of high void fraction in the fragmented mass. This can cause undesirable gas channeling.

In another embodiment of practice of this invention, the lower region 30*a* of the zone of unfragmented formation can be expanded downwardly toward the void 28 using a detonation sequence similar to one of the exemplary detonation sequences described above for expansion of the upper region 30*b*. Further, when the lower region 30*a* is expanded downwardly in more than one layer, a detonation sequence similar to one of the exemplary sequences described above for expansion of the upper region 30*b* can be used for expansion of any desired number of the layers of the lower region.

Although, in the above described embodiments, the zone of unfragmented formation 30 is expanded in upper and lower regions, if desired, the entire zone can be expanded upwardly toward the void 26 and downwardly toward the void 28 in a single round using detonation sequences similar to those described for expansion of the upper region 30*b*.

Alternatively, practice of principles of this invention can be used in an embodiment where only one void is excavated in a subterranean formation and a zone of unfragmented formation is left above or below the void. In this instance, blastholes are formed in the zone of unfragmented formation from the earth's surface and the blastholes are loaded with explosive. The explosive is then detonated in a time delay sequence similar to a sequence illustrated in one of the exemplary embodiments above for expanding the zone of unfragmented formation upwardly or downwardly toward the void.

In the above described embodiments, the retort inlet or plurality of inlets and the retort outlet or plurality of outlets can be formed either prior to the explosive expansions of the zone or zones of unfragmented formation or alternatively, if desired, can be formed after the fragmented mass is formed.

Referring to FIG. 1, during retorting operations, the fragmented permeable mass 12 is ignited through the drift 22 or other inlet openings along the upper edge of the retort at the juncture of the side boundary 20*a* and the top boundary 16. After ignition, air or other suitable retort inlet mixture is introduced through the upper level inlet to the fragmented mass. The retort inlet mixture sustains the combustion zone established in the fragmented mass and causes it to advance diagonally through the retort from the inlet to the outlet. Off-gas is withdrawn through the lower level drift 24 or other outlet openings along the lower edge of the retort at the juncture of the side boundary 20*b* and the bottom boundary 18. Thus, the gas flow through the fragmented mass takes a path generally skewed from vertical, in this case a generally diagonal path from the upper edge of the retort at the first side boundary 20*a* toward the lower edge of the retort at the second side boundary 20*b*.

Additional details of gas flow and combustion zone advance through a retort similar to the retort 10 can be found in U.S. patent application Ser. No. filed by Messrs. Studebaker, Hutchins, Kvapil, and Ricketts on June 15, 1981 titled "In Situ Oil Shale Retort with Diagonal Gas Flow". U.S. patent application Ser. No. 273,964 is assigned to the assignee of this application and is incorporated herein by this reference.

During retorting operations, combustion gas produced in the combustion zone passes through the fragmented mass to establish a retorting zone on the advancing side of the combustion zone, where kerogen in oil shale is retorted to produce liquid and gaseous products of retorting. The liquid products including shale oil and water and the off-gas containing gaseous products both pass to the bottom of the fragmented mass and into the retort outlet 24. The liquid products and the off-gas are separately withdrawn from the outlet.

The above description of methods for forming retorts and for retorting in accordance with practice of principles of this invention is for illustrative purposes. Because of variations which will be apparent to those skilled in the art, the present invention is not intended to be limited to the particular embodiments described above. The scope of the invention is defined in the following claims.

What is claimed is:

1. A method for forming an in situ oil shale retort in a retort site in a subterranean formation containing oil shale, the in situ oil shale retort site having top, bottom, and side boundaries of unfragmented formation, comprising the steps of:

(a) excavating at least one void in the subterranean formation extending between the side boundaries of the retort site, leaving at least one zone of unfragmented formation within the boundaries of the retort site and having a horizontal free face adjacent such a void;

(b) explosively expanding such a zone of unfragmented formation toward the void for forming a fragmented permeable mass of formation particles in the in situ oil shale retort by:

(i) explosively expanding a first portion of the zone of unfragmented formation located between the horizontal center of such a zone of unfragmented formation and a first side boundary of the retort site; and thereafter (ii) sequentially explosively expanding remaining portions of the zone of unfragmented formation in a time delay sequence progressing away from the first portion of said zone of unfragmented formation;

(c) forming at least one retort inlet adjacent the intersection of the first side boundary of the retort site and the top boundary of the retort site for introduction of a retort inlet mixture; and (d) forming at least one retort outlet adjacent the intersection of a second side boundary of the retort site and the bottom boundary of the retort site for withdrawal of off-gas, the second side boundary being on the opposite side of the retort site from the first side boundary.

2. A method for forming an in situ oil shale retort in a retort site in a subterranean formation containing oil shale, the in situ oil shale retort site having top, bottom, and side boundaries of unfragmented formation, comprising the steps of:

(a) excavating at least one void in the subterranean formation extending between the side boundaries of the retort site, leaving at least one zone of unfragmented formation within the boundaries of the retort site and having a horizontal free face adjacent such a void;

(b) placing a plurality of horizontally spaced apart explosive charges in such a zone of unfragmented formation for explosively expanding the zone of unfragmented formation toward the void for forming a fragmented permeable mass of formation particles in the retort;

(c) detonating the explosive charges by:

(i) detonating at least one first explosive charge located between the horizontal center of the zone of unfragmented formation and a first side boundary of the retort site; and after a first time delay (ii) detonating explosive charges progressing in bands away from such first explosive charge with an additional time delay between detonation of each successive band of explosive charges for forming the fragmented permeable mass of formation particles in the in situ retort;

(d) forming at least one retort inlet adjacent the intersection of the first side boundary of the retort site and the top boundary of the retort site for introduction of a retort inlet mixture; and (e) forming at least one retort outlet adjacent the intersection of a second side boundary of the retort site and the bottom boundary of the retort site for withdrawal of off-gas, the second side boundary being on the opposite side of the retort site from the first side boundary.

3. The method according to claim 2 wherein such a first explosive charge is at least about one crater radius from the first side boundary of the retort site.

4. The method according to claim 3 wherein a plurality of first explosive charges are detonated substantially simultaneously and at least one such first explosive charge is about one crater radius from the first side boundary of the retort site.

5. The method according to claim 2 wherein such a first explosive charge is located between the horizontal center of the retort and such a retort inlet.

6. The method according to claim 2 wherein the plurality of explosive charges comprise a square array of explosive charges which extends across the zone of unfragmented formation.

7. The method according to claim 6 wherein the time delays between adjacent bands of explosive charges are at least about one millisecond per foot of distance between adjacent explosive charges.

8. The method according to claim 2 comprising detonating explosive charges progressing in bands outwardly from such a first explosive charge.

9. The method according to claim 2 comprising placing the plurality of horizontally spaced apart explosive charges in horizontally spaced apart rows parallel to the first and second side boundaries of the retort site and detonating the explosive charges by:

(a) detonating at least one first explosive charge in a row located between the center of the zone of unfragmented formation and the first side boundary of the retort site; and after a first time delay (b) detonating explosive charges progressing in rows away from the row comprising such a first explosive charge.

10. A method for forming an in situ oil shale retort in a retort site in a subterranean formation containing oil shale, the in situ oil shale retort site having top, bottom, and side boundaries of unfragmented formation, comprising the steps of:

(a) excavating a void in the subterranean formation extending between the side boundaries of the retort site, leaving a zone of unfragmented formation within the boundaries of the retort site adjacent the void;

(b) placing a plurality of horizontally spaced apart explosive charges in the zone of unfragmented formation for explosively expanding the zone of unfragmented formation toward the void for forming a fragmented permeable mass of formation particles in the retort;

(c) detonating the explosive charges by:

(i) detonating at least one first explosive charge located between the horizontal center of the zone of unfragmented formation and a first side boundary of the retort site; and after a first time delay (ii) detonating explosive charges progressing in bands outwardly from such first explosive charge with an additional time delay between detonation of each successive band of explosive charges for forming the fragmented permeable mass of formation particles in the in situ retort, (d) forming at least one retort inlet adjacent the intersection of the first side boundary of the retort site and the top boundary of the retort site for introduction of a retort inlet mixture; and (e) forming at least one retort outlet adjacent the intersection of a second side boundary of the retort site and the bottom boundary of the retort site for withdrawal of off-gas, the second side boundary being on the opposite side of the retort site from the first side boundary.

11. The method according to claim 10 wherein such a first explosive charge is at least one crater radius from the first side boundary of the retort site.

12. The method according to claim 11 wherein a plurality of first explosive charges are detonated substantially simultaneously and at least one such first explosive charge is about one crater radius from the first side boundary of the retort site.

13. The method according to claim 10 wherein such a first explosive charge is located between the horizontal center of the retort and such a retort inlet.

14. A method for forming an in situ oil shale retort in a retort site in a subterranean formation containing oil shale, the in situ oil shale retort site having top, bottom, and side boundaries of unfragmented formation, comprising the steps of:

(a) excavating at least one void in the subterranean formation extending between the side boundaries of the retort site, leaving at least one zone of unfragmented formation within the boundaries of the retort site and having a horizontal free face adjacent such a void;

(b) forming at least one retort inlet adjacent the intersection of a first side boundary of the retort site and the top boundary of the retort site for introduction of a retort inlet mixture;

(c) forming at least one retort outlet adjacent the intersection of a second side boundary of the retort site and the bottom boundary of the retort site for withdrawal of off-gas, the second side boundary being on the opposite side of the retort site from the first side boundary;

(d) forming horizontally spaced apart rows of explosive charges in such a zone of unfragmented formation for explosively expanding the zone of unfragmented formation toward the void for forming a fragmented permeable mass of formation particles in the retort;

(e) detonating the explosive charges in a time delay sequence comprising:

(i) detonating explosive charges in a first row located between the horizontal center of the zone of unfragmented formation and the first side boundary of the retort site; and thereafter (ii) detonating explosive charges in rows progressing laterally from the first row toward at least the second side boundary of the retort site.

15. The method according to claim 14 wherein the rows of explosive charges are about parallel to the first and second side boundaries of the retort site and the first row of explosive charges is at least about one crater radius from the first side boundary of the retort site.

16. The method according to claim 14 wherein the first row of explosive charges is about one crater radius from the first side boundary of the retort site.

17. A method for forming an in situ oil shale retort in a retort site in a subterranean formation containing oil shale, the in situ oil shale retort site having top, bottom, and side boundaries of unfragmented formation comprising the steps of:

(a) excavating at least one void in the subterranean formation extending between the side boundaries of the retort site, leaving at least one zone of unfragmented formation within the boundaries of the retort site and having a horizontal free face adjacent such a void;

(b) forming at least one retort inlet adjacent the intersection of a first side boundary of the retort site and the top boundary of the retort site for introduction of a retort inlet mixture;

(c) forming at least one retort outlet adjacent the intersection of a second side boundary of the retort site and the bottom boundary of the retort site for withdrawal of off-gas, the second side boundary being on the opposite side of the retort site from the first side boundary;

(d) placing a plurality of horizontally spaced apart explosive charges in such a zone of unfragmented formation for explosively expanding the zone of unfragmented formation toward the void for forming a fragmented permeable mass of formation particles in the retort; and (e) detonating explosive charges in a time delay sequence commencing at a location between the horizontal center of the retort site and the first side boundary and progressing primarily away from the first side boundary for asymmetrically mounding the fragmented permeable mass of formation formed by such detonations higher nearer the first side boundary and lower further from the first side boundary.

18. A method for forming an in situ oil shale retort in a retort site in a subterranean formation containing oil shale, the in situ oil shale retort site having top, bottom, and side boundaries of unfragmented formation, comprising the steps of:

(a) excavating an upper void in the subterranean formation extending between the side boundaries and adjacent the top boundary of the retort site;

(b) excavating a lower void in the subterranean formation extending between the side boundaries and adjacent the bottom boundary of the retort site, leaving a zone of unfragmented formation extending between the upper and lower voids, such a zone of unfragmented formation comprising an upper region adjacent the upper void and a lower region adjacent the lower void;

(c) placing a plurality of first explosive charges in the lower region and detonating the first explosive charges for explosively expanding the lower region toward the lower void, forming a fragmented permeable mass of formation particles in the retort while leaving a void space between the top of such a fragmented mass and the bottom of the upper region of the zone of unfragmented formation;

(d) forming a retort inlet adjacent the intersection of a first side boundary of the retort site and the top boundary of the retort site for introduction of a retort inlet mixture;

(e) forming a retort outlet adjacent a second side boundary of the retort site and the bottom boundary of the retort site for the withdrawal of off-gas, the second side boundary being on the opposite side of the retort site from the first side boundary;

(f) placing a plurality of second explosive charges in the upper region of the zone of unfragmented formation for expanding the upper region upwardly toward the upper void and downwardly toward the void space, the second explosive charges being in horizontally spaced apart rows about parallel to the first and second side boundaries;

(g) detonating such second explosive charges in a time delay sequence comprising:

(i) detonating at least one explosive charge in a first row of second explosive charges between the horizontal center of the zone of unfragmented formation and the first side boundary of the retort site; and thereafter (ii) detonating second explosive charges in rows progressing laterally from the first row of second charges toward at least the second side boundary of the retort site.

19. The method according to claim 18 wherein all of the explosive charges in the upper and lower regions are detonated in the same single round.

20. The method according to claim 18 wherein the first explosive charges are in horizontally spaced apart rows in the lower region of the zone of unfragmented formation parallel to the first and second side boundaries and said first explosive charges are detonated in a time delay sequence comprising:

(a) detonating at least one explosive charge in a first row of first explosive charges between the horizontal center of the zone of unfragmented formation and the first side boundary of the retort site; and thereafter (b) detonating such first explosive charges in rows progressing laterally from the first row toward the first and second side boundaries of the retort site.

21. The method according to claim 20 wherein all of the explosive charges in the upper and lower regions are detonated in the same single round.

22. The method according to claim 18 wherein such a first row of second explosive charges is at least about one crater radius from the first side boundary of the retort site.

23. The method according to claim 20 wherein such a first row of second explosive charges is about one crater radius from the first side boundary of the retort site.

24. The method according to claim 20 wherein such rows of second explosive charges comprise a square array of explosive charges which extends across the zone of unfragmented formation.

25. The method according to claim 24 wherein the time delays in the time delay sequence are at least about one millisecond per foot of distance between adjacent second explosive charges.

26. A method for forming an in situ oil shale retort in a retort site in a subterranean formation containing oil shale, the in situ oil shale retort site having top, bottom, and side boundaries of unfragmented formation comprising the steps of:

(a) excavating an upper void in the subterranean formation extending between the side boundaries and adjacent the top boundary of the retort site;

(b) excavating a lower void in the subterranean formation extending between the side boundaries and adjacent the bottom boundary of the retort site, leaving a zone of unfragmented formation extending between the upper and lower voids, such a zone of unfragmented formation comprising an upper region adjacent the upper void and a lower region adjacent the lower void;

(c) placing a plurality of first explosive charges in the lower region and detonating the first explosive charges for explosively expanding the lower region toward the lower void forming a fragmented permeable mass of formation particles in the retort while leaving a void space between the top of such a fragmented mass and the bottom of the upper region of the zone of unfragmented formation;

(d) forming a retort inlet adjacent the intersection of a first side boundary of the retort site and the top boundary of the retort site for introduction of a retort inlet mixture;

(e) forming a retort outlet adjacent the intersection of a second side boundary of the retort site and the bottom boundary of the retort site for withdrawal of off-gas, the second side boundary being on the opposite side of the retort site from the first side boundary;

(f) placing an array of horizontally spaced apart second explosive charges in the upper region of the zone of unfragmented formation for explosively expanding the upper region upwardly toward the upper void and downwardly toward the void space;

(g) detonating the second explosive charges in a time delay sequence comprising:

(i) first, detonating at least one second explosive charge located between the horizontal center of the zone of unfragmented formation and the first side boundary of the retort site; and after a first time delay (ii) detonating a remainder of the second explosive charges progressing in bands outwardly from such a second explosive charge first detonated with an additional time delay between detonation of each successive band of second explosive charges for forming the fragmented permeable mass of formation particles in the in situ oil shale retort.

27. The method according to claim 26 wherein all of the explosive charges in the upper and lower regions are detonated in the same single round.

28. The method according to claim 26 wherein the first explosive charges are horizontally spaced apart from each other in an array extending across the lower region of the zone of unfragmented formation and such first explosive charges are detonated in a time delay sequence comprising:

(a) detonating at least one explosive charge located between the horizontal center of the zone of unfragmented formation and the first side boundary of the retort site; and after a first time delay (b) detonating a remainder of the first explosive charges progressing in bands outwardly from such a first explosive charge first detonated with an additional time delay between detonation of each successive band of first explosive charges.

29. The method according to claim 28 wherein all of the explosive charges in the upper and lower regions are detonated in the same single round.

30. The method according to claim 26 wherein such a second explosive charge detonated first is at least about one crater radius from the first side boundary of the retort site.

31. The method according to claim 26 wherein such a second explosive charge detonated first is located about between the center of the retort and the retort inlet.

32. A method for forming an in situ oil shale retort in a retort site within a subterranean formation containing oil shale, the retort site having top, bottom, and generally vertically extending side boundaries of unfragmented formation, comprising the steps of:

(a) excavating an upper level drift in the subterranean formation adjacent the top boundary of the retort site;

(b) excavating an upper void in an upper portion of the retort site adjacent the upper level drift, the upper level drift opening into the upper void through a first side boundary of the retort site;

(c) excavating a lower level drift in the subterranean formation adjacent the bottom boundary of the retort site;

(d) excavating a lower void in a lower portion of the retort site adjacent the lower level drift while leaving a zone of unfragmented formation extending between the upper and lower voids, the lower level drift opening into the lower void through a second side boundary of the retort site, wherein the second side boundary is on the opposite side of the retort site from the first side boundary;

(e) placing explosive charges in a lower region of the zone of unfragmented formation and detonating the explosive charges for explosively expanding the lower region downwardly toward the lower void forming a first portion of a fragmented permeable mass of formation particles in the in situ oil shale retort while leaving a void space between the top of the first portion of the fragmented permeable mass and the bottom of an upper region of the zone of unfragmented formation;

(f) placing an array of horizontally spaced apart second explosive charges in the upper region of the zone of unfragmented formation for explosively expanding the upper region upwardly toward the upper void and downwardly toward the void space, the array of second explosive charges comprising rows of charges wherein such rows are about parallel to the first and second side boundaries of the retort site;

(g) detonating the second explosive charges in a time delay sequence comprising:

(i) detonating explosive charges in a first row between the horizontal center of the zone of unfragmented formation and the first side boundary of the retort site; and thereafter (ii) detonating explosive charges in rows progressing laterally from the first row toward at least the second side boundary of the retort site.

33. The method according to claim 32 wherein the first row of explosive charges is at least about one crater radius from the first side boundary of the retort site.

34. The method according to claim 32 wherein the first row of explosive charges is about one crater radius from the first side boundary of the retort site.

35. The method according to claim 32 wherein the array of second explosive charges is a square array which extends across the upper region of the zone of unfragmented formation.

36. The method according to claim 35 wherein the time delays in the time delay sequence are at least about one millisecond per foot of distance between adjacent second explosive charges.

37. A method for forming an in situ oil shale retort in a retort site within a subterranean formation containing oil shale, the retort site having top, bottom, and generally vertically extending side boundaries of unfragmented formation, comprising the steps of:

(a) excavating an upper level drift in the subterranean formation adjacent the top boundary of the retort site;

(b) excavating an upper void in an upper portion of the retort site adjacent the upper level drift, the upper level drift opening into the upper void through a first side boundary of the retort site;

(c) excavating a lower level drift in the subterranean formation adjacent the bottom boundary of the retort site;

(d) excavating a lower void in a lower portion of the retort site adjacent the lower level drift while leaving a zone of unfragmented formation extending between the upper and lower voids, the lower level drift opening into the lower void through a second side boundary of the retort site, wherein the second side boundary is on the opposite side of the retort site from the first side boundary;

(e) explosively expanding a lower region of the zone of unfragmented formation downwardly toward the lower void forming a first portion of a fragmented permeable mass of formation particles in the in situ oil shale retort while leaving a void space between the top of the first portion of the fragmented permeable mass and the bottom of an upper region of the zone of unfragmented formation; and thereafter (f) explosively expanding the upper region of the zone of unfragmented formation both upwardly toward the upper void and downwardly toward the void space for forming a remaining portion of the fragmented permeable mass of formation particles, the explosive expansion of the upper region of the zone of unfragmented formation comprising:

(i) explosively expanding a first portion of the upper region of the zone of unfragmented formation located between the horizontal center of such a zone of unfragmented formation and the first side boundary of the retort site; and thereafter (ii) sequentially explosively expanding remaining portions of the upper region of the zone of unfragmented formation in a time delay sequence progressing away from the first portion of said upper region.

38. The method according to claim 37 wherein the first portion of the upper region of the zone of unfragmented formation is between the horizontal center of the retort and the upper level drift.

39. A method for recovering liquid and gaseous products from an in situ oil shale retort formed in a retort site in a subterranean formation containing oil shale, such an in situ oil shale retort containing a fragmented permeable mass of formation particles containing oil shale formed within top, bottom, and side boundaries of the retort site, the method comprising the steps of:

(a) excavating an upper level drift in the subterranean formation adjacent the top boundary of the retort site;

(b) excavating an upper void in an upper portion of the retort site adjacent the upper level drift, the upper level drift opening into the upper void through a first side boundary of the retort site;

(c) excavating a lower level drift in the subterranean formation adjacent the bottom boundary of the retort site;

(d) excavating a lower void in a lower portion of the retort site adjacent the lower level drift while leaving a zone of unfragmented formation extending between the upper and lower voids, the lower level drift opening into the lower void through a second side boundary of the retort site, wherein the second side boundary is on the opposite side of the retort from the first side boundary;

(e) explosively expanding a lower region of the zone of unfragmented formation downwardly toward the lower void, forming a first portion of a fragmented permeable mass of formation particles in the in situ oil shale retort while leaving a void space between the top of the first portion of the fragmented permeable mass and the bottom of an upper region of the zone of unfragmented formation; and thereafter (f) explosively expanding the upper region of the zone of unfragmented formation both upwardly toward the upper void and downwardly toward the void space for forming a remaining portion of the fragmented permeable mass of formation particles, the explosive expansion of the upper region of the zone of unfragmented formation comprising:

(i) first, explosively expanding a first portion of the upper region of the zone of unfragmented formation located between the horizontal center of such a zone of unfragmented formation and the first side boundary of the retort site; and thereafter (ii) sequentially explosively expanding remaining portions of the upper region of the zone of unfragmented formation in a time delay sequence progressing away from the first portion of said upper region, the fragmented permeable mass of formation particles substantially filling the retort site in the region adjacent the upper level drift and extending between the upper level drift and the lower level drift;

(g) igniting the fragmented permeable mass of formation particles in a region of the fragmented mass adjacent the upper level drift;

(h) introducing a retort inlet mixture comprising an oxygen-supplying gas into the fragmented mass through the upper level drift for sustaining the combustion zone;

(i) withdrawing an off-gas from the fragmented mass through the lower level drift, wherein gas flow from the upper level drift toward the lower level drift advances the combustion zone diagonally through the fragmented mass from the upper level drift toward the lower level drift and forms a retorting zone on the advancing side of the combustion zone for producing liquid and gaseous products of retorting; and (j) withdrawing the gaseous products of retorting from the fragmented mass through the lower level drift.

40. The method according to claim 39 wherein the first portion of the upper region of the zone of unfragmented formation is located between the center of the retort site and the upper level drift.

41. A method for recovering liquid and gaseous products from an in situ oil shale retort formed in a retort site in a subterranean formation containing oil shale, such an in situ oil shale retort containing a fragmented permeable mass of formation particles containing oil shale formed within top, bottom, and side boundaries of the retort site, the method comprising the steps of:

(a) excavating an upper level drift in a subterranean formation adjacent the top boundary of the retort site;

(b) excavating an upper void in an upper portion of the retort site adjacent the upper level drift, the upper level drift opening into the upper void, through a first side boundary of the retort site;

(c) excavating a lower level drift in the subterranean formation adjacent the bottom boundary of the retort site;

(d) excavating a lower void in a lower portion of the retort site adjacent the lower level drift while leaving a zone of unfragmented formation extending between the upper and lower voids, the lower level drift opening into the lower void through a second side boundary of the retort site wherein the second side boundary is on the opposite side of the retort site from the first side boundary;

(e) placing explosive charges in a lower region of the zone of unfragmented formation and detonating the explosive charges for explosively expanding the lower region downwardly toward the lower void, forming a first portion of a fragmented permeable mass of formation particles in the in situ oil shale retort, while leaving a void space between the top of the first portion of the fragmented permeable mass and the bottom of an upper region of the zone of unfragmented formation;

(f) placing an array of horizontally spaced apart second explosive charges in the upper region of the zone of unfragmented formation for explosively expanding the upper region of the zone of unfragmented formation both upwardly toward the upper void and downwardly toward the void space for forming a remaining portion of the fragmented permeable mass of formation particles, wherein the array of second explosive charges comprises a plurality of rows of horizontally spaced apart explosive charges wherein the rows are about parallel to the first and second side boundaries of the retort site;

(g) detonating the second explosive charges in a time delay sequence comprising:

(i) detonating explosive charges in a first row located between the horizontal center of the zone of unfragmented formation and the first side boundary of the retort site; and thereafter (ii) detonating explosive charges in rows progressing laterally from the first row toward both the first and second side boundaries of the retort site for forming a remaining portion of the fragmented permeable mass of formation particles, said fragmented mass substantially filling the retort site in the region adjacent the upper level drift, and extending between the upper level drift and the lower level drift;

(h) igniting the fragmented permeable mass of formation particles in a region of the fragmented mass adjacent the upper level drift;

(i) introducing a retort inlet mixture comprising an oxygen-supplying gas into the fragmented mass through the upper level drift for sustaining the combustion zone;

(j) withdrawing an off-gas from the fragmented mass through the lower level drift, wherein gas flow from the upper level drift toward the lower level drift advances the combustion zone diagonally through the fragmented mass from the upper level drift toward the lower level drift and forms a retorting zone on the advancing side of the combustion zone for producing liquid and gaseous products of retorting; and (k) withdrawing the gaseous products of retorting from the fragmented mass through the lower level drift.

42. The method according to claim 41 wherein the first row of second explosive charges is at least about one crater radius from the first side boundary of the retort site.

43. The method according to claim 41 wherein the first row of second explosive charges is about one crater radius from the first side boundary of the retort site.

44. A method for forming an in situ oil shale retort in a retort site in a subterranean formation containing oil shale, the in situ oil shale retort site having top, bottom, and generally vertically extending side boundaries of unfragmented formation, comprising the steps of:

(a) excavating a void in the subterranean formation extending between the side boundaries of the retort site, leaving a zone of unfragmented formation within the boundaries of the retort site and having a horizontal free face adjacent the void;

(b) forming at least one retort inlet through a first side boundary of the retort site about adjacent the top boundary of the retort site for introduction of a retort inlet mixture;

(c) forming at least one retort outlet through a second side boundary of the retort site adjacent the bottom boundary of the retort site for withdrawal of off-gas, the second side boundary being on the opposite side of the retort site from the first side boundary;

(d) placing a plurality of horizontally spaced apart explosive charges in the zone of unfragmented formation; and (e) detonating the explosive charges in an asymmetrical time delay sequence for explosively expanding such a zone of unfragmented formation toward the void for forming an asymmetrical fragmented permeable mass of formation particles in the retort, such a fragmented permeable mass of formation particles completely filling the retort to the top boundary in a region adjacent such a retort inlet, while leaving a void space in a region of the retort opposite such a retort inlet which extends between the surface of the fragmented mass and the top boundary of the retort.

45. An in situ oil shale retort in a retort site in a subterranean formation containing oil shale comprising:

(a) top, bottom, and generally vertical side boundaries of unfragmented formation;

(b) inlet means adjacent the intersection of a first side boundary of the retort and the top boundary of the retort for introducing a retort inlet mixture into said retort;

(c) outlet means adjacent the intersection of a second side boundary of the retort and the bottom boundary of the retort for withdrawing off-gas from said retort, the second side boundary being on the opposite side of the retort from the first side boundary; and (d) a fragmented permeable mass of formation particles filling the retort to its top boundary in the region of the retort adjacent the inlet means and not filling the retort to its top boundary adjacent the side of the retort opposite from the inlet means.

* * * * *